United States Patent [19]

Bayer

[11] Patent Number: 4,688,703

[45] Date of Patent: Aug. 25, 1987

[54] TUBE-SHAPED CONTAINER

[75] Inventor: Michael Bayer, Cologne, Fed. Rep. of Germany

[73] Assignee: Bayer Aktiengesellschaft, Fed. Rep. of Germany

[21] Appl. No.: 826,509

[22] Filed: Feb. 5, 1986

[30] Foreign Application Priority Data

Feb. 16, 1985 [DE] Fed. Rep. of Germany ... 8504383[U]

[51] Int. Cl.[4] ..... B65D 47/10; B65D 51/22

[52] U.S. Cl. ..... 222/541; 220/258; 220/274; 215/215

[58] Field of Search ..... 215/201, 204, 209, 215, 215/250, 253; 220/258, 266, 274, 284; 222/541

[56] References Cited

U.S. PATENT DOCUMENTS

| | | | |
|---|---|---|---|
| 3,416,712 | 12/1968 | Shastal | 222/541 |
| 3,684,115 | 2/1971 | Birch | 215/215 |
| 3,777,949 | 12/1973 | Chiquiari-Arias | 222/541 |
| 3,841,513 | 10/1974 | O'Connor et al. | 215/215 |
| 4,098,417 | 7/1978 | Bennett | 215/215 |
| 4,382,512 | 5/1983 | Furminger | 220/284 |
| 4,598,839 | 7/1986 | Dombroski et al. | 220/258 |

*Primary Examiner*—John E. Kittle
*Assistant Examiner*—James J. Seidleck
*Attorney, Agent, or Firm*—Connolly and Hutz

[57] ABSTRACT

The tube has a peg-shaped neck extension (3) at its upper end, which contains a predetermined breaking point (4). The neck extension (3) is generally positioned under the removable protective cap (7). A short socket (9) is formed on the upper side of the cap (7) in an axial direction, the interior diameter of which is slightly greater than the diameter of the neck extension (3). The inner surface of this socket (9) and the outer surface of the neck extension (3) are provided with corresponding notch flanges (5) or notch grooves (10), such that the cap (7) and the neck extension (3) are non-positively connected to each other when rotated about the longitudinal axis, when the cap (7) with the socket (9) is positioned on the peg-shaped neck extension (3). If the cap (7) is rotated in this position about the longitudinal axis with slight pressure simultaneously exerted then the peg-shaped neck extension (3) is sheared off at the predetermined breaking point (4) and the tube is thereby opened. The cap (7) thus acts as protective cap on the one hand and as a tool for opening the tube on the other hand.

2 Claims, 2 Drawing Figures

TUBE-SHAPED CONTAINER

BACKGROUND OF THE INVENTION

The invention relates to a tube-shaped container for a pasty or liquid product having a peg-shaped neck extension which is formed as tube sealing device, which can be broken off and which is covered by a removable cap. In so far as such tubes are used as packagings for pharmaceutical products (ointments or solutions), care must be taken that the neck of the tube if possible remains germ-free when the tube is opened. In German Pat. No. 2 653 993, a container with a seal which can be broken off is described, the head piece of which is formed in a particular manner and is thereby protected against soiling and the deposition of germs when opened.

Another demand which is made especially on packagings whose contents include materials which are damaging to health relates to the problem of child safety. This means that opening the packaging is deliberately made more difficult by additional constructive measures, such that children cannot easily open the packaging.

SUMMARY OF THE INVENTION

This is where the invention comes into play. The object is to provide a tube-shaped container with a special sealing device, which on the one hand can be opened by the consumer without external auxiliary means and on the other hand is formed in such a complicated manner that it is generally not possible to open the tube accidentally or during play.

This object is achieved according to the invention with a tube-shaped container having a peg-shaped neck extension which is formed as tube sealing device, which can be broken off and which is covered by a cap, such that a socket is centrally formed on the outside of the cap in an axial direction, the diameter of which is slightly greater than the diameter of the neck extension. Moreover, the socket is provided on the inside and the neck extension on the outside with notch flanges or notch grooves, such that the cap and and the neck extension are non-positively connected to each other on rotation about the longitudinal axis, when the cap is inverted to open the container and is pushed with the socket over the neck extension. The cap usefully ends with the socket in a flush manner; that is, the cap extends to the end of the socket.

According to a preferred embodiment, an annular gap is present at the level of the socket between the outer wall of the cap and the socket, and a circular flange is arranged on the neck of the tube, the diameter of which circular flange corresponds to the diameter of the annular gap and the depth of which corresponds to about the length of the neck extension.

By these measures, the peg-shaped neck extension cannot be easily broken off by the fingers. For opening, the cap must rather first be removed, inverted and, with the socket, pushed over the neck extension. The peg-shaped neck extension is sheared off by a subsequent rotational movement and by a slight axial pressure simultaneously exerted on the cap. The opening of the tube is thereby uncovered so that the contents can be removed. The basic principle of the sealing device is thus that the cap is used as a tool for opening the tube.

The invention is explained in more detail below by means of an embodiment shown in the drawing,

DETAILED DESCRIPTION OF THE PREFERRED EMBODIMENTS

Figure 1:
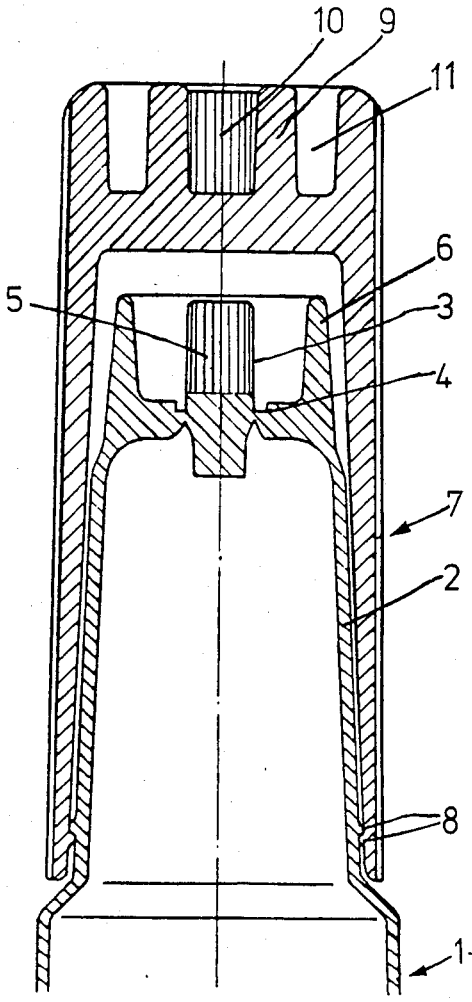
FIG. 1 shows the head section of the tube with the cap in position in a sealed state, as the tube is supplied by the producer

According to FIG. 1, the tube has a conical neck 2, at the end of which a peg-shaped neck extension or twist-off tab 3 is formed. There is a predetermined breaking point 4 at the connection of the neck extension 3 to the neck of the tube 2. The cylindrical neck section 3 is provided with longitudinal flanges 5 on its surface in a corrugated manner. A circular flange 6 is positioned on the upper side of the neck of the tube 2. The circular flange 6 is at least as high as the neck extension 3, that is the neck extension 3 is sunk in the recess formed by the circular flange 6. The diameter of the circular flange 6 and the height of the neck extension 5 only amount to a few millimeters, such that it is practically impossible to break off the neck extension 3 with the fingers.

The cap 7 is pushed over the neck of the tube 2, which cap has a conical inner contour adapted to the neck of the tube 2. Locking elements 8 are applied to the neck of the tube 2 and the cap 7, so that the cap 7 cannot be easily pulled off. Moreover, the tolerances of the conical contours are not critical, since there can remain a certain play between the neck of the tube 2 and the cap 7 and at this position no sealing closing device is necessary.

A short socket 9 is axially formed on the upper side of the cap 7, the clear width of which is slightly greater than the diameter of the neck extension 3. The difference in diameter is, for example, from 0.1 to 0.01 mm. The length of the socket 9 practically coincides with the length of the neck extension 3. The inner surface of the section of tube is provided with longitudinal grooves 10, which correspond in number and dimension to the longitudinal flanges 5 on the neck extension 3. The outer wall of the cap 7 reaches the height of the section of tube 9; that is the cap 7 ends in a flush manner with the socket 9. Between the socket 9 and the outer wall of the cap, an annular gap 11 remains on the upper side, the diameter of which approximately coincides with the diameter of the circular flange 6 on the neck of the tube 2. The depth of the annular gap 11 likewise corresponds to the height of the circular flange 6.

Figure 2:
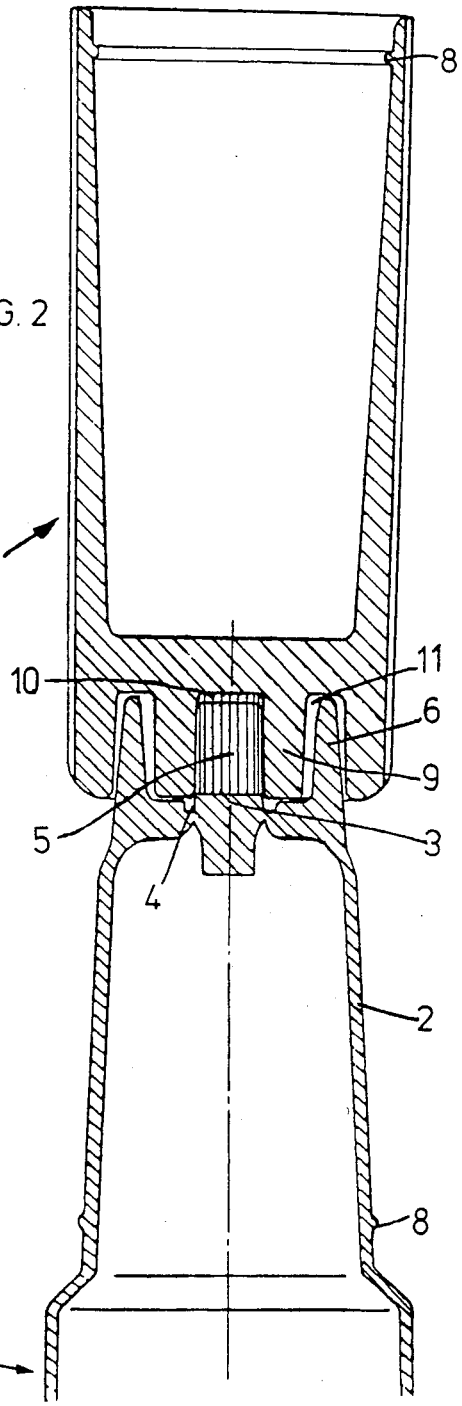
FIG. 2 shows the tube opened by means of the cap positioned in an inverted manner.

The transverse dimensions of the circular flange 6 and the annular gap 11 are calculated such that the circular flange 6 fits into the annular gap 11 with play when, as shown in FIG. 2, the upper side of the cap 7 is placed on the neck of the tube 2. According to FIG. 2, the cap 7 is thus pulled from the neck of the tube 2, inverted and with the socket 9, pushed over the neck extension 3. The circular flange 6 is thereby pushed into the annular gap 11. The longitudinal flanges 5 on the neck extension 3 hereby positively contact the annular grooves 10 of the section of tube 9, such that the cap 7 in the position according to FIG. 2, cannot be rotated about the longitudinal axis without simultaneously exerting a torsional force on the neck extension 3. The cap 7 is thus formed as a tool with which a turning moment can be exerted on the neck extension 5 and, with corresponding dimensioning of the length of the socket 9, an axial pressure can also be exerted on the neck extension 3. On exceeding a limit value predetermined by the predetermined breaking point 4, the neck extension 3 is sheared off so that the opening of the tube is uncovered. The contents of the tube can then be removed in conventional manner.

It is clear that owing to these constructive measures, the tube can no longer be opened in the usual manner. Rather, four additional stages are necessary (removing the cap 7, inverting the cap 7, replacing the cap 7 on the neck of the tube, shearing off the neck extension 3). A certain safety is thus produced in that the sealing device cannot be opened accidentally or by children at play. The new sealing device is particularly designed for tube packagings which are used only once.

A further advantage is that the construction of the sealing device is simple and it can thus easily be injection moulded. Polypropylene can be used, for example, as material which is processed with suitably designed injection moulding tools.

I claim:

1. A container having a dispensing nozzle at one end thereof, a severable axially extending twist-off tab at the dispensing nozzle attached to the nozzle by a predetermined breaking point, the twist-off tab having longitudinal serrations on its outer surface, a circular flange constructed and arranged to outwardly extend from the nozzle and to enclose the tab, a removable closure cap for sealing the dispensing nozzle having an elongated top portion including an axially extending socket with a diameter slightly greater than the diameter of the tab, and serrations within the socket complementary to the serrations on the tab for interconnecting the socket and tab together when the closure cap is removed and inverted and the socket is fitted over the tab whereby exerting rotational force on the cap twists the tab away from the nozzle at the predetermined breaking point.

2. A container as in claim 1 wherein the top portion of the removable closure cap includes an annular recess therein constructed and arranged to accommodate the flange outwardly extending from the nozzle when the closure cap is removed and inverted and the socket is fitted over the tab.

* * * * *